US009175580B2

(12) United States Patent
Kubota et al.

(10) Patent No.: US 9,175,580 B2
(45) Date of Patent: Nov. 3, 2015

(54) MECHANICAL LASH ADJUSTER

(75) Inventors: Yukio Kubota, Hadano (JP); Michihiro Kameda, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 0 days.

(21) Appl. No.: 14/385,427

(22) PCT Filed: Mar. 16, 2012

(86) PCT No.: PCT/JP2012/056841

§ 371 (c)(1),
(2), (4) Date: Sep. 15, 2014

(87) PCT Pub. No.: WO2013/136508

PCT Pub. Date: Sep. 19, 2013

(65) Prior Publication Data

US 2015/0075470 A1 Mar. 19, 2015

(51) Int. Cl.

| | |
|---|---|
| ***F01L 1/14*** | (2006.01) |
| ***F01L 1/22*** | (2006.01) |
| ***F01L 1/18*** | (2006.01) |

(52) U.S. Cl.
CPC .. *F01L 1/22* (2013.01); *F01L 1/185* (2013.01)

(58) Field of Classification Search
CPC ..... F01L 1/22; F01L 1/185
USPC ..... 123/90.45, 90.52, 90.53, 90.54, 90.65
See application file for complete search history.

(56) References Cited

U.S. PATENT DOCUMENTS 4,706,620 A 11/1987 Gill
8,136,493 B2 * 3/2012 Yamaguchi et al. ..... 123/90.45

FOREIGN PATENT DOCUMENTS

JP 61-502553 A 11/1986
JP 03-001203 U 1/1991
JP 2007-154852 A 6/2007

OTHER PUBLICATIONS

International Search Report dated Jun. 19, 2012, issued in corresponding application No. PCT/JP2012/056841.

* cited by examiner

*Primary Examiner* — Ching Chang
(74) *Attorney, Agent, or Firm* — Westerman, Hattori, Daniels & Adrian, LLP

(57) ABSTRACT

The mechanical lash adjuster is arranged between a cam and one end of the stem of a valve urged by a valve spring. The lash adjuster comprises an unrotatable housing having a thread, a plunger subjected to the force of the cam and formed with a thread in engagement with the thread of the housing, and a plunger spring urging the plunger against the action of the valve spring. The lead and flank angles of the engaging threads are set such that the engagement threads can slidably rotate under a given shaft load applied to the plunger unless the frictional torque TB, generated by the friction between the slidable frictional surface F2 of the plunger and a shaft load transmission member to act on the plunger, exceeds the thrust torque TF imparted by the shaft load to the plunger.

4 Claims, 9 Drawing Sheets

(a)

(b)

MECHANICAL LASH ADJUSTER

TECHNICAL FIELD

This invention relates to a mechanical lash adjuster of a valve operating mechanism of an internal combustion engine for automatically adjusting the valve clearance of the valve operating mechanism, where the valve clearance is defined basically to be a distance between the cam of the valve operating mechanism and a valve stem of a valve, and particularly in a rocker arm type valve mechanism to be a gap between the rocker arm and the valve stem and, in a direct valve driving mechanism, a gap between the plunger and the valve stem.

BACKGROUND ART

A well known mechanical lash adjuster of a rocker arm type mechanical lash adjuster has a rocker arm operably connected to a valve stem of an intake/exhaust valve installed in the cylinder head of an automobile engine so that the valve clearance is automatically adjusted by extension and retraction of the lash adjuster which serves as a fulcrum of the rocker arm. (See for example Patent Documents 1 and 2, and non-patent document 1 listed below.)

This type of mechanical lash adjuster has: a cylindrical housing formed with an internal female thread; a pivot member formed with a male thread on its exterior, with a lower portion of the pivot member retained in the housing; and a plunger spring (compression coil spring) biasing the pivot member upward towards an upper rocker arm, wherein the male and female threads are engaged together to form buttress threads. In this mechanical lash adjuster, the thread angles (lead and flank angles of the buttress threads) are set such that the buttress threads undergo relative sliding rotation to extend the pivot member to automatically adjust the valve clearance under an axial load applied thereto, but otherwise become unrotatable not to retract the pivot member by the friction between the two engaging threads. Such suppression of the rotation of threads by the friction between them will be hereinafter referred to as independence of the threads.

PRIOR ART DOCUMENTS

Patent Documents

Patent Document 1: JPA Early Publication S61-5025553 (FIGS. 1-5)

Patent Document 2: Utility Model Laid Open H3-1203 (FIGS. 1-3)

Non-Patent Document

Non-patent Document 1: NTN Technical Review, No. 75(2007), "Development of End-Pivot Type Mechanical Lash Adjuster".

SUMMARY OF THE INVENTION

Objects of the Invention

Although conventional mechanical lash adjusters can extend a pivot member to decrease an incremented valve clearance, they cannot positively increase a decreased valve clearance (by retracting the pivot member) to nullify the valve clearance, except for compensation of a backlash of the threads through retraction of the pivot member.

FIG. 9 shows in enlarged view a shape of a male thread (buttress thread) of a pivot member used in a conventional mechanical lash adjuster. It is noted that the lead angle $\alpha'$ of the male thread of the pivot member is set to a predetermined angle such that the engaging thread can slidably rotate in either direction of an axial shaft load applied thereto. That is, the pivot member can retract (downward in FIG. 9), or extend (upward in FIG. 9), in the direction of the shaft load applied.

The upper flank angle $\theta 2$ is also set, in association with the lead angle $\alpha'$ of the thread, to a predetermined angle (for example 15 degrees) so as to allow the pivot member to extend through relative rotational motion of the engaging threads under an upward axial load. On the other hand, in association with the lead angle $\alpha'$ of the thread, the lower flank angle $\theta 1$ is set to an angle (for example 75 degrees) such that, under an axial shaft load that tends to retract the pivot member, the engaging threads become independent due to the friction between the two threads.

As a consequence, when the valve clearance has increased, the pivot member can extend to decrease the valve clearance through its rotational sliding motion on the counter-thread under the force of the plunger spring. However, when the valve clearance has decreased, the pivot member cannot rotate to retract due to a large frictional torque generated by the friction between the engaging threads, failing to increase the valve clearance.

In the event where a heated engine is stopped and cooled quickly, the valve clearance can become much too small (negative) to be adjusted by the lash adjuster due to the fact that there is a large difference in the thermal expansion coefficient between a cylinder head (normally aluminum) and a valve (ferrous alloy). In that case the valve seat face will levitate off the valve seat insert. Similar levitation of the valve seat face also takes place when the valve seat insert is worn too much to be adjusted by the lash adjuster.

Since pivot members of conventional lash adjusters cannot retract to increase a (decreased) valve clearance under such circumstances as mentioned above, the deficiency in valve clearance is left uncorrected, rendering the valve lift excessively large at the time of re-stating the cold engine, thereby loosing sealability of the valve seat face with the valve seat insert (or the hermiticity of the combustion chamber).

Although there have been made many propositions and improvements to solve the problem over many years, no satisfactory mechanical lash adjuster has been provided yet.

Conventional mechanical lash adjusters utilize buttress threads consisting of a male and a female thread, which poses a problem that the threads inadvertently become "independent" under a frictional torque due to the friction between the threads. The inventors of the present invention have found that this problem can be circumvented by providing a lash adjuster with a pivot member, in place of the buttress threads, in frictional contact with a shaft load transmission member of the rocker arm for example such that the adjuster stops relative sliding rotation of the threads when a frictional torque due to the friction between the pivot member and a shaft load transmission member takes place.

It is noted that the male and female threads of the mechanical lash adjuster can slidably rotate relative to each other under a shaft load acting on the pivot member in either axial direction without becoming independent, and that, by properly setting up the lead and the flank angles of the threads, a frictional torque generated primarily by a slidable frictional surface of the pivot member in contact with the shaft load transmission member (such as a rocker arm) can prevent the relative sliding rotation of the threads, thereby rendering the threads unrotatable (this unrotatable condition of the engaging threads will be referred to as unrotatable condition of the threads). Under the unrotatable condition of the engaging threads (with the pivot member being stationary), the pivot member of the lash adjuster functions as a rocked fulcrum of the rocker arm in contact with a rotating camshaft (of the valve operating mechanism). But otherwise the threads can slidably rotate relative to each other, allowing the pivot member to move in one axial direction to decrease the valve clearance or in the other direction to increase the valve clearance (unlike conventional lash adjusters).

More particularly, the pivot member of a rocker arm type valve operating mechanism is subjected to a shaft load (which equals the cam force in balance with a resultant force of reactive forces of a plunger spring and a valve spring). This shaft load imparts a thrust torque to the engaging threads, causing on one hand the pivot member to be rotated and on the other hand generating a first frictional torque that tends to suppress the sliding rotation of the threads, due to the friction between the threads. At the same time, the pivot member is subjected to a second frictional torque generated by the friction between the slidable frictional surface of the pivot member in contact with a rocker arm. This second frictional torque also tends to suppress the rotation of the pivot member. If the thrust torque exceeds the sum of the first and second frictional torques, the engaging threads undergo relative sliding rotation, but otherwise the relative rotation of the threads is prevented.

It is noted that the first frictional torque can be neglected so long as the threads can undergo relative rotation under a thrust shaft load in one axial direction or another by appropriately setting the lead and flank angles of the engaging threads. Thus, the rotational and stationary conditions of the threads can be controlled by controlling the torque balance between the thrust torque and the second frictional torque. To do this, it suffices to set the lead and flank angles of the threads such that the engaging threads remain stationary when the second frictional torque exceeds the thrust torque (that is, thrust torque ≤ second frictional torque).

The effectiveness of such configuration of a mechanical lash adjuster has been verified with pre-productive lash adjusters and materialized as the present application for patent.

In view of foregoing technical problems pertinent to conventional mechanical lash adjusters, it is an object of the present invention to provide an innovative mechanical lash adjuster capable of automatically adjusting increased/decreased valve clearance of a valve

Means for Solving the Problem

To solve the problems discussed above, there is provided in accordance with the present invention a mechanical lash adjuster for adjusting a valve clearance of a valve, the adjuster arranged between a cam of a valve operating mechanism and one end of a stem of the valve urged by a valve spring for closing a valve port, the lash adjuster comprising: a plunger subjected to a shaft load exerted by the cam; an unrotatably secured plunger engagement member in threaded engagement with an engagement thread of the plunger to allow axial movements of the plunger; and a plunger spring urging the plunger against an action of the valve spring, the lash adjuster characterized in that lead and flank angles of the engaging threads are set so as to:

allow the plunger to extend or retract in the axial direction of a shaft load applied thereto through sliding rotation of the engaging threads;

but render the engaging threads unrotatable primarily due to a frictional torque that acts on a slidable frictional surface of the plunger in contact with a shaft load transmission member of the lash adjuster prohibits a relative rotations of the engaging thread.

There are two types of mechanical lash adjusters: a lash adjuster for use with a rocker arm type valve operating mechanism in which the lash adjuster is indirectly arranged between the valve stem and the cam; and a lash adjuster for use with a direct acting type valve operating mechanism in which the lash adjuster is directly arranged between the valve stem and the cam.

In the lash adjuster for a rocker arm type mechanical valve operating mechanism, the lash adjuster is arranged indirectly between the cam and the valve stem so that the cam force and the force of the valve spring act on the plunger of the lash adjuster via a rocker arm. In contrast, in the lash adjuster for a direct acting valve operating mechanism, the lash adjuster is arranged directly between the valve stem and the cam so that the cam force and the force of the valve spring directly act on the plunger and the plunger engagement member of the lash adjuster.

Apart from the type of the valve operating mechanism, lash adjusters are categorized into a first and a second group, depending on which of the plunger and the plunger engagement member is formed with a male (or female) thread for the engaging threads.

FIGS. 1, 6, and 8 illustrates engaging threads of a first, a second and a fourth embodiment, respectively. A lash adjuster of the first group comprises: an unrotatable cylindrical housing serving as the plunger engagement member which is provided in the inner surface thereof with a female thread; a plunger provided on the exterior thereof with a male thread in engagement with the female thread of the housing; and a plunger spring, housed in the plunger housing, for urging the plunger against the action of the valve spring.

A lash adjuster of the second group, in accordance with a third embodiment of the invention shown in FIG. 7, comprises: an unrotatable rod member serving as a plunger engagement member and provided on the exterior thereof with a male thread; a plunger formed in the interior thereof with a female thread in engagement with the male thread of the rod member; and a plunger spring installed between the rod member and the plunger to urge the plunger against the action of the valve spring.

(Function) The plunger of the lash adjuster of a valve operating mechanism is subjected to a shaft load exerted by a cam (which equals the sum of the reactive forces of the valve spring and the plunger spring). This shaft load transmitted to the engaging threads turns out on one hand to be a thrust torque that urges mutual rotation of the engaging threads, and on the other hand gives rise to a first frictional torque that suppresses the rotation of the engaging threads. At the same time, a second frictional torque for suppressing the relative rotation of the engaging thread of the plunger is also generated by the friction between the slidable frictional surface of the plunger and the shaft load transmission member (which is the rocker arm in the case of a rocker arm type valve operating mechanism or the one end of a valve stem in contact with the plunger in the case of a direct acting type valve operating mechanism).

Whether the engaging thread of the plunger undergoes relative rotation or not to move in an axial direction during an opening/closing operation of a valve (that is, during operation of the engine) depends on the balance between the thrust torque and the resultant frictional torque of the first and second torque.

However, so long as the plunger can move in either axial direction under a shaft load applied thereto through the relative rotation of the engaging threads during a valve opening/closing operation, the first frictional torque generated by the friction between the engaging threads of the plunger and the plunger engaging member (which is a housing (22, 122), and a rod member (114) in the embodiments described below) can be neglected.

As a consequence, whether the engaging threads can undergo relative rotation (allowing the plunger to move in the axial direction of a given shaft load) or not (relative rotation prohibited) during a valve operation depends on the torque balance between the thrust torque TF acting on the engaging thread of the plunger and the second frictional torque (hereinafter referred to as braking torque TB) acting on the plunger in contact with the shaft load transmission member.

It is noted that, as the cam rotates, the valve lift gradually increases from zero (when the valve is closed) to a maximum (when the valve is fully opened), and then decreases to zero, and that, in either of a valve opening process in which a shaft load is supplied only by the plunger spring to open the closed valve until the valve is fully opened with a maximum shaft load and a valve closing process in which the shaft load decreases from the maximum load until the shaft load is supplied only by the plunger spring, the engaging threads become unrotatable relative to each other when a braking torque TB generated by the frictional force acting on a friction surface of the plunger in contact with the shaft load transmission member exceeds a thrust torque TF generated by a force exerted to the engaging threads. Under such unrotatable condition of the engaging threads, the plunger of the lash adjuster serves as a fulcrum of the rocker arm rocked by the rotating cam to open/close the valve. On the other hand, when the thrust torque TF exceeds the braking torque TB, the engaging threads can undergo relative rotation, causing the plunger to be moved in the axial direction of the shaft load.

Accordingly, if the valve clearance has increased, the plunger is extended to decrease the valve clearance during a valve opening/closing operation, particularly when for example only the force of the plunger spring acts on the plunger as the shaft load immediately before an end of a valve lifting operation), thereby annihilating incremented valve clearance.

On the other hand, if the valve clearance has decreased, the plunger is retracted to increase the valve clearance during a valve closing/opening operation, particularly when for example the cam exerts a near-maximum shaft load to the plunger, thereby annihilating the decrement in the valve clearance.

As an example, when a heated engine is stopped and quickly cooled, adjustment of the valve clearance by the lash adjuster may be insufficient for a change in valve clearance induced by a difference in thermal expansion coefficient between the cylinder head (made of an aluminum alloy) and a valve (made of an iron alloy). As a consequence, the valve seat face can "float" off the valve seat insert at the time of the next startup of the engine under such condition. A similar phenomenon can take place when the valve seat insert is excessively worn and the valve seat face floats from the valve seat insert at a startup of the engine due to an insufficient valve clearance.

To resolve such insufficient (or negative) valve clearance problem, the present invention provides a lash adjuster that allows the plunger to move in its axial direction in synchronism with a valve opening/closing operation during a startup of the engine for example (when the near-maximum or maximum cam force acts on the plunger as the shaft load), so as to increase the valve clearance (compensating for the insufficiency). Thus, if the cold engine is re-started, the valve lift will never be too large nor too small, so that the hermiticity of the combustion room (or the sealability of the valve seat face with the valve seat insert) will be secured.

The lead angles of the engaging threads recited in claim 1 may be chosen in the range from 10 to 40 degrees and the flank angles in the range from 5 to 45 degrees, as recited in claim 2.

The male (or female) thread of the engaging threads can be either trapezoidal or triangular thread. The threads can be equi-flank threads having the same upper and lower flank angle, or can be non-equi-flank threads having different upper and lower flank angles.

(Function) When the lead angles of the engaging threads are less than 10 degrees, the threads cannot rotate smoothly relative to each other due to the influence of the friction angle. On the other hand, when the lead angles exceed 40 degrees, it is difficult to prohibit the rotation of the engaging threads by the frictional torque acting on the slidable frictional surface of the plunger in contact with the shaft load transmission member.

It is therefore preferable to set the lead angles of the engaging threads to an angle in the range between 10 and 40 degrees so that the engaging threads can slidably rotate relative to each other and allows the plunger to extend or retract in either axial direction of a shaft load applied thereto and that such rotation is prevented by a frictional torque generated between the sliding slidable frictional surface of the plunger and the shaft load transmission member. More particularly, the lead angles are set up in accordance with the frictional torque generated on the frictional faces between the plunger and the shaft load transmission member. For example, the lead angles are set up small (large) when a relatively large (small) frictional torque be generated by a given shaft load that acts on the plunger.

If the flank angles are less than 5 degrees, the engaging threads behave like square threads, where their friction angles are so small that any flank angles do not make sense any more for the purpose of controlling the friction. Further, it is too difficult to achieve high-precision fabrication of engaging threads that are not affected by any lead angle error. On the other hand, if the flank angles exceed 45 degrees, fabrication of threads is easy but usability of the threads is lost due to the fact that the threads can become easily independent, so that the flank angle cannot be a control parameter any longer.

Therefore, appropriate lead angles are first set for the plunger and the shaft load transmission member in sliding contact therewith, in accord with the magnitude of the frictional torque generated on their slidable frictional surfaces. Then, considering the fact that the threads are easily (not easily) slidable if the flank angles are large (small), appropriate flank angles are chosen to ensure slidability and adequate timing of the sliding rotation of the threads.

The engaging threads of the plunger and the plunger engagement member recited in claim 1 or 2 may be multi-lead threads (or multi-start threads), as recited in claim 3.

A multi-lead thread has a multiplicity of threads spaced in parallel in the axial direction, which advantageously provides a larger pitch than a single-lead thread. In particular, if a large lead angle be set, as in the present invention, to ensure sliding rotation of the engaging threads for extensible or retractable movement of the plunger under a given shaft load, a standard multi-lead thread having a pitch in harmony with the diameter of the thread, a thread shape, and lead and flank angles can be selected in accordance with the Japanese Industrial Standard (JIS).

Thus, engaging threads having preferred lead and flank angles can be selected from a wide range of multi-lead threads.

Further, use of multi-lead threads permits reduction of the surface pressure that acts on the engaging threads under a given shaft load, which helps reduce wear of the threads.

Results of the Invention

As would be understood from the above description, if the valve clearance has increased or decreased by chance, the mechanical lash adjuster of the invention will automatically correct the valve clearance by causing the plunger to be moved in a manner to annihilate any such change in the clearance through relative rotations of the engaging threads during a valve opening/closing operation.

According to the invention recited in claim 2, the lead angles and the flank angles of the engaging threads are set in accordance with a frictional torque generated by the sliding thread surface of the plunger in contact with a shaft load transmission member such that, if the valve clearance has changed, the plunger smoothly moves in one direction to annihilate the change in valve clearance, thereby automatically, quickly, and correctly adjust the valve clearance.

According to the invention recited in claim 3, ranges of lead angles and the flank angles of the engaging threads to be set can be extended by use of multi-lead threads, which in turn enables provision of varied mechanical lash adjusters having different thrust torque characteristics and braking torque characteristics.

It is noted that multi-lead threads do not wear even when they are subjected to a large shaft load, so that the invention can provide a mechanical lash adjuster for a valve operating mechanism that can be subjected to a large shaft load.

BEST MODE FOR CARRYING OUT THE INVENTION

The invention will now be described in detail by way of example with reference to the accompanying drawings. Referring to FIGS. 1 through 5, there is shown a mechanical lash adjuster 20 in accordance with the first embodiment.

Figure 1:
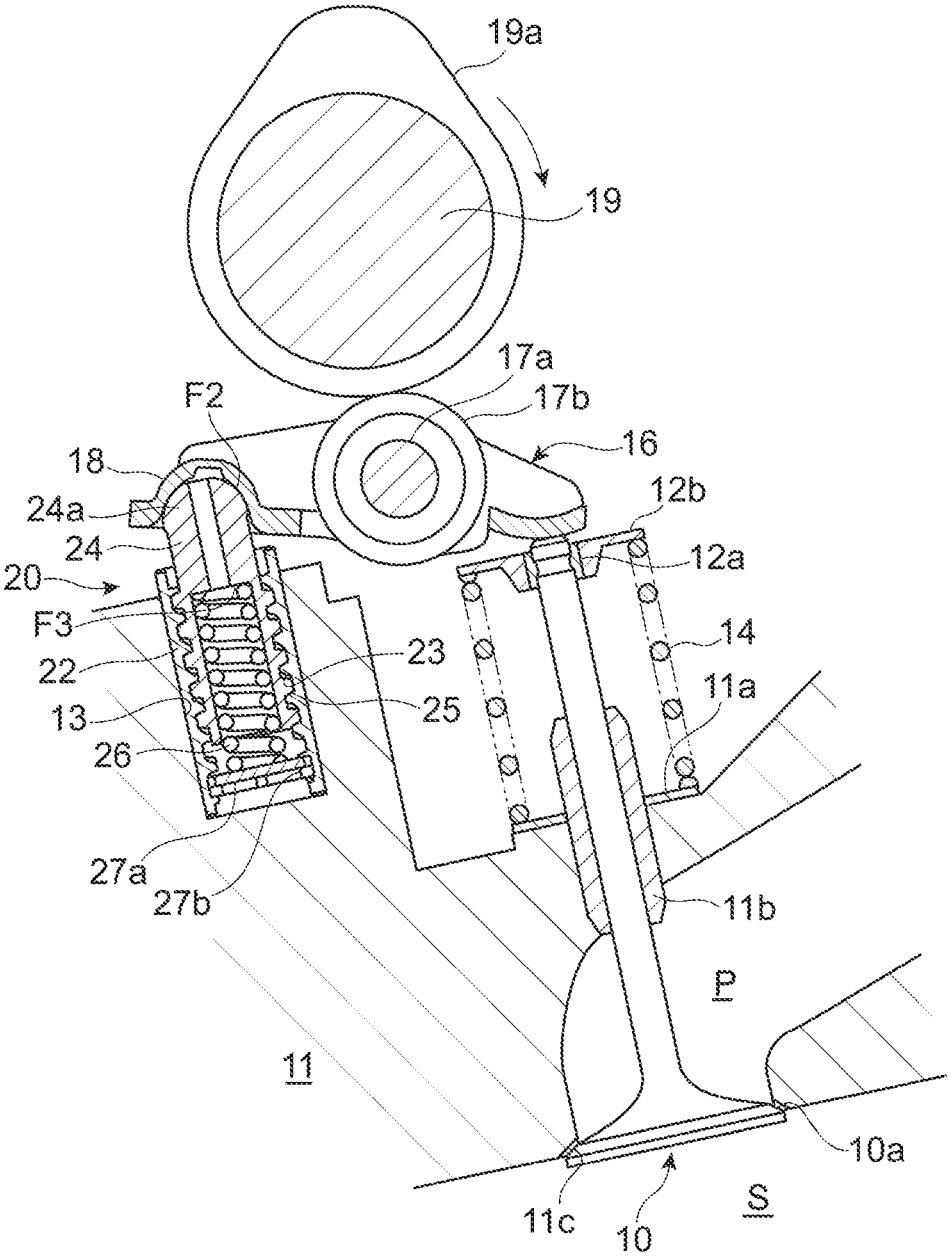
FIG. 1 is a cross section of a rocker arm type valve operating mechanism utilizing a mechanical lash adjuster in accordance with a first embodiment of the invention.

FIG. 1 shows a rocker arm type valve operating mechanism, in which an air intake (exhaust) valve 10 is arranged across an air intake (exhaust) port P of a cylinder head 11. A cotter 12*a* and a spring retainer 12*b* are provided round one end of the stem of the valve 10. There is provided a valve spring 14 between a spring seat 11*a* and the spring retainer 12*b* to urge the valve 10 upward (FIG. 1) to close the port. Symbol 11*b* indicates a cylindrical valve slide guide; symbol 10*a* a valve seat face formed on the periphery of a valve head of the valve 10, and symbol 11*c* a valve seat insert provided on and along the open end of the air intake/exhaust port P of a combustion chamber S.

A rocker arm 16 has one end abutting against one end of the stem of the valve 10, and at the other end thereof a socket section 18 engaged with a pivot section 24*a* of a plunger 24 of the mechanical lash adjuster 20.

The rocker arm 16 is provided at a longitudinally medium position thereof with a roller 17*b*, which is supported by a roller shaft 17*a* to be in contact with a cam 19*a* mounted on a camshaft 19.

The mechanical lash adjuster 20 is provided with: a cylindrical housing 22 serving as a plunger engagement member, which is inserted in a vertical bore 13 formed in the cylinder head 11, and is provided inside thereof with a female thread 23; a plunger 24 which is provided on the exterior thereof with a male thread in engagement with the female thread 23 when arranged in the cylindrical housing 22; and a plunger spring 26 installed in the cylindrical housing 22 to urge the plunger 24 upward (that is, in the direction to extend the plunger out of the housing) as shown in FIG. 1. Reference symbol 27*a* indicates a disk shape spring seat plate installed inside, and on the bottom of, the cylindrical housing 22. Symbol 27*b* indicates a C ring for securely fixing the spring seat plate 27*a* to the cylindrical housing 22.

Thus, under a shaft load exerted by the cam 19*a*, the plunger 24 is in threaded engagement with the housing 22 (serving as plunger engagement member) via the engaging threads (which consists of the male thread 25 of the plunger 24 and the female thread 23 of the unrotatable housing 22).

Although the cylindrical housing 22 is inserted in the bore 13 with its lower end abutting on the bottom of the bore 13, the housing 22 is not force fitted in the bore 13. (That is, no baffle means for stopping the rotation of the housing is provided.) However, under a downward shaft load applied to the plunger 24 via the rocker arm 16, the frictional torque generated by the friction between the lower end of the cylindrical housing 22 and the bottom of the bore 13 effectively stops the rotation of the cylindrical housing 22 relative to the bore 13. In other words, the cylindrical housing 22 is held unrotatable by the frictional torque generated.

While the base circle of the cam 19*a* is in contact with (the roller 17*b* of) the rocker arm 16 (that is, while the cam nose is not in contact with the roller 17*b*), the plunger 24 is subjected solely to the force of the plunger spring 26.

Figure 2:
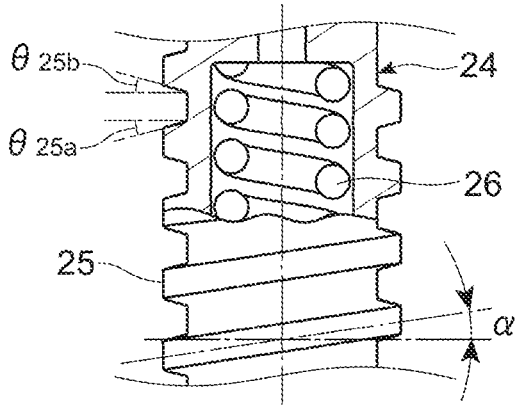
FIG. 2 shows in detail a primary portion of the mechanical lash adjuster of the first embodiment. More particularly, FIG. 2(*a*) shows the lead angle and the flank angle of a male thread formed on the plunger, and FIG. 2 (*b*) shows the lead angle and the flank angle of a female thread formed in the housing.
Figure 2:
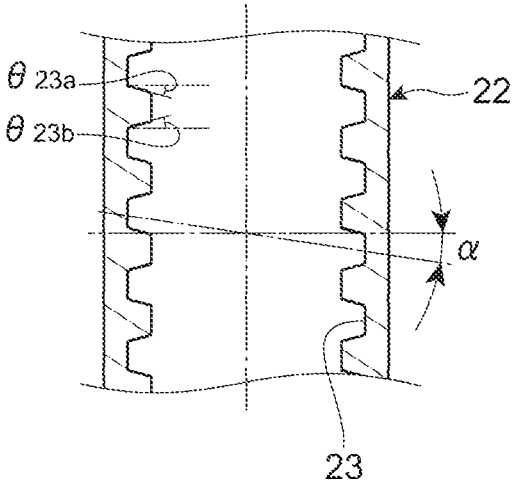

The male thread 25 of the plunger 24 and the female thread 23 of the housing 22 in threaded engagement with the male thread 25 are trapezoidal threads, as shown in enlarged view in FIGS. 2 (*a*) and (*b*). The lead angle α of the male thread 23 (and of the female thread 23) is set to 30 degrees for example, and the upper flank angle θ25*a* (θ23*a*) and the lower flank angle θ25*b* (θ23*b*) of the male thread 25 (and of the female thread of the housing 22) is set to 30 degrees for example. The plunger 24 can move in either axial direction of a shaft load applied thereto through sliding rotation of the engagement threads unless the rotation of engaging threads is prevented by a resultant frictional toque of a frictional torque that acts on a slidable frictional surface F2 of the pivot section 24*a* of the plunger 24 in slidable contact with a socket 18 of the rocker arm 16 (FIG. 1) and a frictional torque that acts on a slidable frictional surface F3 of the plunger 24 in contact with the plunger spring 26 (FIG. 1).

In other words, the lash adjuster 20 is rotatable under a shaft load in either axial direction of the shaft load through sliding rotation of the engaging threads unless a resultant braking torque arising from the friction acting on the slidable frictional surfaces F2 and F3 surpasses the thrust torque acting on the plunger 24 and keeps the plunger unrotatable. Under this condition, the pivot section 24*a* at the leading end of the plunger 24 serves as the fulcrum of the rocker arm 16 rocking in association with the rotation of the camshaft 19. It should be understood that the lead angles and the flank angles of the male thread 25 and female thread 23 are appropriately set to 30 degrees, for example, for this purpose.

Looking more closely at the thread configuration, it is seen that the plunger 24 of the lash adjuster 20 is subjected to a shaft load W, which is a resultant force of the reactive force of the valve spring 14 and the reactive force of the plunger spring 26, and that a thrust torque TF is generated by the shaft load W so as to rotate the male thread 25 of the plunger 24 relative to the female thread 23 of the cylindrical housing 22. At the same time, there will be generated a first torque that acts on the engagement thread of the plunger 24, a second frictional torque that acts on the slidable frictional surface F2 of the pivot member 24*a* in contact with the socket 18 of the rocker arm 16, and a third frictional toque that acts on the frictional face F3 of the plunger in contact with the plunger spring 26.

It is noted that whether the engaging threads undergo a sliding rotation (accompanying an axial movement of the plunger 24) or not during a valve opening/closing operation depends on the balance between the thrust torque TF and a resultant torque of the first, second, and third frictional torques.

However, when the plunger 24 can rotatably extend or retract in the direction of the shaft load applied, the frictional torque that occurs in the engaging threads during valve opening and closing operation can be neglected in the sense that the plunger 24 is moved by the shaft load. In other words, since the thrust torque imparted to the thread by the shaft load is given by the following equation thrust torque=driving torque−(first) frictional torque,
the (first) frictional torque is implicit.

That is, it can be neglected in terms of the thrust torque.

Accordingly, whether the engaging threads are rotatable (that is, plunger 24 is movable in the axial direction of the shaft load applied) during a valve opening/closing operation or not (that is, engaging threads are mutually unrotatable) depends on the balance between the thrust torque TF acting on the threads and a resultant frictional torque (referred to as braking torque) of the second frictional torque acting on the sliding surface F2 of the pivot 24*a* of the plunger 24 in contact with the socket 18 of the rocker arm 16 and the third frictional torque acting on the sliding surface F3 of the plunger 24 in contact with the plunger spring 26.

The thrust torque TF is a resultant torque of the thrust torque TFbs generated by the reactive force of the valve spring 14 and the thrust torque TFps generated by a reactive force of the plunger spring 26. The thrust torque TF is proportional to the shaft load W as shown in FIG. 3(*a*).

Figure 3:
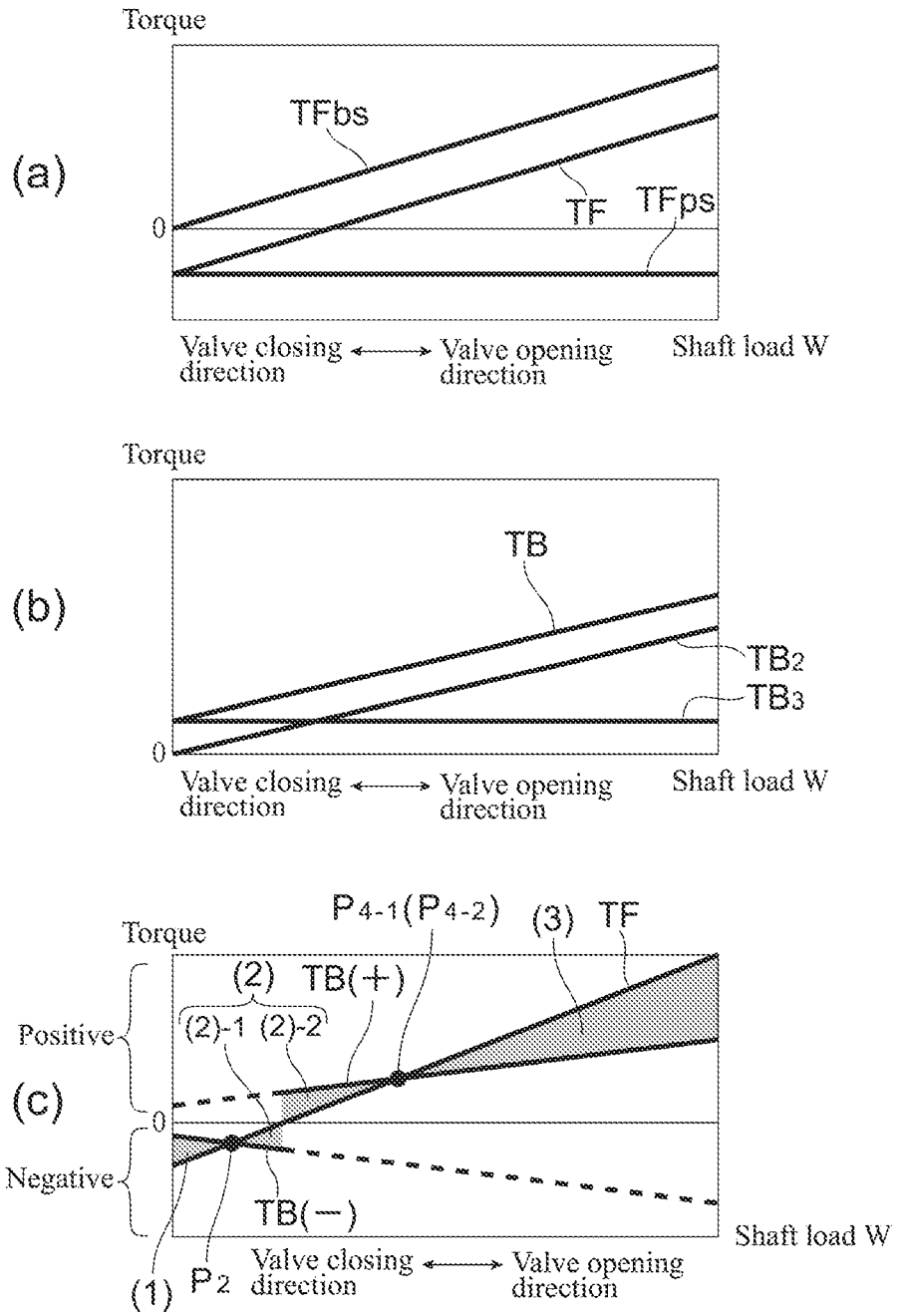
FIG. 3(*a*) illustrates a thrust torque acting on the engaging thread of the plunger as a function of the shaft load W, and FIG. 3(*b*) a braking torque acting on the thread of the plunger (suppressing the sliding movement or relative rotation thereof) as a function of the shaft load W, and FIG. 3(*c*) the balance between the thrust torque and the braking torque as functions of shaft load W.

On the other hand, the braking torque TB suppressing the mutual rotation of the engaging threads is a resultant torque of the second frictional torque TB2 acting on the sliding surface F2 of pivot 24*a* of the plunger 24 and the third frictional torque TB3 acting on the sliding surface F3 of the plunger, that is, $$TB=TB2+TB3$$

which is also proportional to the shaft load W as shown in FIG. 3(*b*).

It should be noted that the plunger spring 26 has a small spring constant and its reactive force is smaller than that of the valve spring 14 and independent of the shaft load W. Consequently, unlike the second frictional torque TB2, the third frictional torque TB3 generated by the reactive force of the plunger spring 26 is substantially constant if the shaft load W is increased (FIG. 3(*b*)).

FIG. 3(*c*) shows how the thrust torque TF and the braking torque TB acting on the plunger 24 vary with the shaft load W during a valve opening-closing operation, as indicated by a TF line representing the thrust torque, a TB(+) line representing the increasing braking torque, and a TB(−) line representing the decreasing braking torque.

The thrust torque TF acting on the plunger 24 during a valve opening operation, linearly increases with the shaft load W from a minimum (negative) value to a maximum (positive) value. On the other hand, the thrust torque TF during a valve closing operation is represented by a leftward descending TF line that starts with the positive maximum value.

It is noted that the thrust torque TF depends on the lead and flank angles of the engaging threads. For example, the characteristic thrust torque line TF becomes steeper (that is, the threads become steeper) as the lead angles increase or as the flank angles decrease (that is, triangular threads change in shape towards trapezoidal or square threads). Conversely, the characteristic thrust torque line TF becomes less steeper as the lead angles are decreased (or becomes less steep), that is, as the square threads change in shape towards trapezoidal or triangular threads.

On the other hand, the braking torque TB decreases linearly as shown by a rightward descending line TB(−) when the thrust torque TF is negative (causing the plunger to be extended upward in FIG. 1), while the braking torque TB increases linearly as shown by an rightward ascending line TB(+) when the thrust torque TF is positive (causing the plunger to be retracted downward in FIG. 1).

FIG. 3 (*c*) shows a shaft load W that varies in relation to the thrust torque TF and the braking torque TB. It is seen that in the course of one complete revolution of the cam 19*a*, the valve 10 is opened once and closed once. The shaft load acting on the plunger 24 is minimum when the plunger is free of any cam force, that is, when the plunger is subjected only to the force of the plunger spring 26. As the cam 19*a* rotates, the cam force increases until the shaft load assumes a maximum, Wmax, and then decreases to zero, leaving the plunger 24 being subjected again only to the force of the plunger spring 26. Thus, it is seen that the mechanical lash adjuster 10 nullifies the valve clearance in the valve opening process as well as in the closing process.

More particularly, in a case where the thrust torque is negative, that is, in the torque balance region where no cam force acts on the plunger so that the plunger is subjected only to the upward force of the plunger spring (FIG. 1) and in a region (1) (FIG. 3 (*c*)) where the thrust torque TF surpasses the braking torque TB(−) in absolute value (|TB(−)|<|TF|) so that the cam 19*a* pushes the rocker arm to lift the valve to a certain degree, until the TB balance out the TF at a point P2, thereby allowing the plunger 24 to move (or extend) in the upward direction of the shaft load (which is the reactive force of the plunger spring 26) through relative rotations of the engagement thread.

Next, in regions (2)-1 and (2)-2 (the regions collectively referred to as region (2)), after the thrust torque TF balanced the braking torque TB (−) at the point P2, the positive thrust torque TF (downward in FIG. 1) acting on the plunger 24 is surpassed by the braking torque TB(−) and by the positive braking torque TB(+) in absolute value, until the thrust torque TF balances out the braking torque Tb(+) at a point P4-1. Consequently, the engaging threads are rendered unrotatable to each other in the region (2) (FIG. 3 (*c*)). As a result, the pivot section 24*a* of the plunger 24 serves as a fulcrum of the rocker arm 16 rocking in response to the camshaft 19 in rotation. The region (2) between the point P2 and the point P4-1 of FIG. 3(*c*) corresponds to a region (2) over a cam angle domain P3 shown in FIG. 4.

After the thrust torque TF is balanced by the braking torque TB(+) at the point P4-1 and thereafter until the shaft load reaches its maximum at the far right end of FIG. 3 (*c*) (where the valve lift becomes maximum), that is, in a region (3) of FIG. 3(*c*), the absolute value of the thrust torque TF exceeds the absolute value of the braking torque TB(+), so that the engaging threads can slidably rotate to each other, causing the plunger 24 to be moved (retracted) by the downward shaft load exerted by the cam 19*a*.

In this way, during the course of valve opening, the thrust torque TF and the braking torque TB acting on the plunger changes with the shaft load applied to the plunger 24, in sequence from the region (1) (where only the force of the plunger spring 26 acts on the plunger 24) to the region (2)−1 and then to the region (2)+1, and further to the region (3) in FIG. 3(*c*). The thrust torque TF and the braking torque TB remains in the region (3) for a while until the valve begins to close. Subsequently, the shaft load gradually decreases, wherein the thrust torque TF and the braking torque TB move from the region (3) back to the region (1) through the region (2) (that is, through the regions (2)-2 and (2)-1) of FIG. 3(*c*).

It is noted that the intersection P2 of the TF line and the TB(−) line shown in FIG. 3(*c*) gives the thrust torque TF in balance with the frictional torque TB(−), across which the torque balance of the thrust torque TF and braking torque TB changes from one in the region (1) to another in the region (2) (or vice versa) as the shaft load acting on the plunger increases (or decreases). Angular point P4-1 (P4-2) represents the point of intersection of the TF line and the TB line, across which the torque balance changes from one in the region (2) to another in the region (3) as the shaft load acting on the plunger 24 increases (decreases).

Since the shaft load and the valve lift become maximum at the far right end of FIG. 3(*c*), the shaft load TF ascends along the TF line to the right end of FIG. 3 (*c*) to give a maximum valve lift (Max Lift) there, and then descend along the same TF line to the left. The evolution of the thrust torque TF between the point P4-1 and the point P4-2 across its maximum (at the far right end of FIG. 3(*c*)) is represented by a cam angle domain P4 in FIG. 4.

Figure 4:
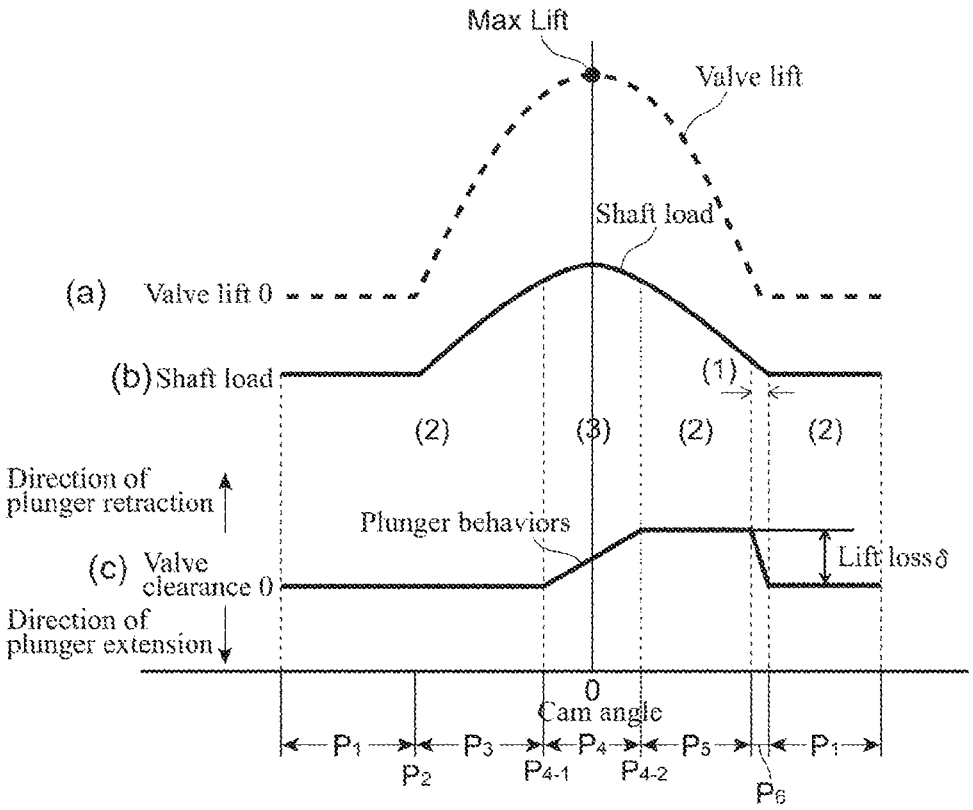
FIG. 4 illustrates a valve lift, a shaft load, and behaviors of the plunger as functions of cam angle when the engine is running at a low rpm.

As the thrust torque TF further decreases past the point P4-2, where the thrust torque TF line crosses the braking torque TB(+) line, the torque balance changes from one in the region (3) to another in the region (2), which takes place in a cam angle domain P5 shown in FIG. 4. As the valve lift decreases further, the shaft load TF also decreases along the TF line, and passes the point of intersection P2 where the thrust torque TF balances the frictional torque TB(−), the torque balance enters a cam angle domain P6 shown in FIG. 4.

In the cam angle domain P6, the plunger 24 can extend itself, compensating for its retraction experienced in the cam angle domain P4 and restore its initial length. After the thrust torque TF descends along the TF line past the point P2, the thrust torque TF is reversed at a point that depends on the valve clearance. The shaft load now ascends rightward along the TF line in the region (1).

Consequently, after the valve clearance is adjusted, the shaft load increases until the braking torque TB(−) balances out the thrust torque TF at the point P2, where the plunger 24 ceases to extend. This occurs in the region (2), which corresponds to a cam angle domain P1 in FIG. 4.

In this way, in the event that the valve clearance has increased, the increment is annihilated by the sliding movement (extension) of the plunger 24 in the region (1) where the absolute value of the TF exceeds the absolute value of the braking torque TB(−), that is, $$|TB(-)|<|TF|.$$

On the other hand, in the case where the valve clearance has decreased, the decrement is annihilated (that is, the valve clearance is increased) by a retraction of the plunger 24 through sliding rotation of the engaging thread of the plunger 24 in the region (3) where the absolute value of the thrust torque TF exceeds the absolute value of the braking torque TB(+), that is, $$|TB(+)|<|TF|.$$

Referring to FIGS. 4(*a*), (*b*), and (*c*) showing variations of the valve lift, shaft load, and plunger movement with cam angle of the cam 19*a*, operation of the mechanical lash adjuster 20 will now be described in detail when the engine is running at a low rpm (less than 3000 for example).

When the contact point of the cam 19*a* in contact with the roller 17*b* of the rocker arm 16 (the point hereinafter simply referred to as contact point) is on the base circle of the cam 19*a* in the cam angle domain P1 in FIG. 4, the cam force does not act on the plunger 24 as a shaft load. Instead, only a predetermined reactive force of the plunger spring 26 acts on the plunger 24 to extend the plunger 24.

Thus, if a positive valve clearance takes place in the valve operating mechanism, the plunger 24 is not subjected to the reactive force of the valve spring 14. That is, the slidable frictional surface F2 of the plunger 24 is not in forced contact with the rocker arm 16, so that only a little friction takes place between them. Since the reactive force of the plunger spring 26 is naturally very small (FIG. 3 (*b*)) that the friction between the slidable frictional surface F3 of the plunger 24 and the plunger spring 26 is also small. Thus, $$|TB(-)|<|TF|$$

Under this condition, the plunger 24 extends upward in FIG. 1 through sliding rotation of its engaging thread.

Consequently, the plunger 24 pushes one end of the rocker arm 16 upward, which in turn forces the other end downward until the valve clearance is nullified. At this moment, significant frictional forces (second and third frictional forces) are generated by the friction between the slidable frictional surface F2 of the plunger 24 and the rocker arm 16 and between the slidable frictional surface F3 of the plunger 24 and the plunger spring 26. As the frictional braking torque TB grows comparable to or larger than the thrust torque TF due to the force of the plunger spring 26

$$\text{thrust torque } TF \leq \text{braking torque } TB,$$

upward motion (or extension) of the plunger 24 is stopped. This stage corresponds to the region (2) over the cam angle domain P1 as shown in FIG. 4.

In this way, when the valve clearance between the rocker arm and the valve stem is increased, the plunger 24 is extended upward to push up one end of the rocker arm 16 to lower the other end thereof while the contact point of the cam roller 17*b* stays on the rocker arm 16, thereby annihilating the incremented valve clearance.

Next, as the cam 19*a* is rotated further so that the contact point shifts from the base circle onto the ramp section of the cam 19*a* (with the cam angle represented by the angular point P2 in FIG. 4), the rocker arm 16 is forced downward by the cam 19*a*, thereby applying a downward shaft load to the plunger 24. At this stage, the plunger 24 is first pushed down for the backlash of the engaging thread (in the order of several tens of micrometers).

It is noted that the downward shaft load exerted by the cam 19*a* via the rocker arm 16 urges the sliding rotation of the engaging thread of the plunger 24. However, this sliding rotation of the engaging thread of the plunger 24 (that would convert the shaft load supplied by the rocker arm 16 to a thrust torque TF) is suppressed by the second frictional force acting on the slidable frictional surface F2 of the plunger 24 in contact with the rocker arm 16 and by the third frictional force acting on the slidable frictional surface F3 of the plunger 24 in contact with the plunger spring 26. In other words, the braking torque TB due to the second and third frictional torques exceeds the thrust torque TF (TF≤TB). Consequently, after the straight downward movement (FIG. 1) for the backlash of the thread, the plunger 24 becomes immovable, with the lower flank of the male thread 25 of the plunger 24 in stationary contact with the upper flank of the female thread 23 of the cylindrical housing 22 (so that the toque balance in the region (2) lasts).

As the cam 19*a* rotates still further and initiates a valve lift (or lowers the valve 10 in FIG. 1), the shaft load acting on the plunger 24 via the rocker arm 16 increases still more. Accordingly, the thrust torque TF acting on the engaging thread, and hence the shaft load acting on the cylindrical housing 22 via the plunger 24, increases. At the same time, however, the friction acting on the slidable frictional surfaces F2 and F3 of the plunger 24 in contact with the rocker arm 16 and the plunger spring 26, respectively, increases in proportion to the shaft load, so does the braking torque TB with the friction. After all, the condition, TF≤TB, remains unchanged, rendering the engaging threads immovable in the region (2) of FIG. 3 or in the cam angle domain P3 shown in FIG. 4.

As the cam 19*a* rotates further, bringing the contact point to a cam angle point P4-1 near the zero point where a maximum valve lift (Max Lift point) is given (FIG. 4), the thrust torque TF acting on the engaging thread of the plunger 24 exceeds the braking torque TB acting on the slidable frictional surfaces F2 and F3, $$TB \leq TF,$$

so that the plunger 24 can be moved downward (FIG. 1) in the region (3) shown in FIG. 3, by the shaft load through its rotation.

This condition lasts until the contact point of the rocker arm 16 and the cam 19 comes to a cam angle point P4-2 (FIG. 4) past the zero point (Max Lift point), since in the region (3) the thrust torque TF acting on the engaging thread of the plunger 24 exceeds the frictional torques TB acting on the slidable frictional surfaces F2 and F3.

Thus, in the region (3) (or in the cam angle domain P4 near the zero point shown in FIG. 4), the braking torque TB< thrust torque TF, so that the plunger 24 is slightly retracted in the direction of the shaft load, inviting a decrease (a lift loss δ) in the intended Max Lift. That is, the valve lift that should be given by the cam 19*a* is decreased by the amount of retraction δ of the plunger 24.

As the cam 19*a* further rotates, bringing the contact point over to a cam angle domain P5 past the cam angle point P4-2 near the zero point (Max Lift point) as shown in FIG. 4, the shaft load acting on the plunger 24 decreases, so that the thrust toque is eventually surpassed by the braking torque TB, $$TF \leq TB.$$

due to the second and third frictional torques acting on the slidable frictional surfaces F2 and F3 of the plunger. Consequently, the relative rotation of the engaging threads is prohibited (in the region (2)), so that the plunger 24 becomes immovable in its axial direction.

As the cam 19*a* rotates still further, the reactive force of the plunger spring 14 (or 26) become weaker, so that the condition $$TF < TB$$

still holds for some time in the region (2), thereby rendering the engaging threads unrotatable and the plunger 24 immovable in its axial direction. Thus, the lift loss δ created in the cam angle domain P4 (FIG. 4) near the zero point (Max Lift point) remains unchanged.

As the contact point of the rocker arm 16 and the cam 16*a* leaves the lump section of the cam 19*a* and enter the base circle of the cam 19*a* (cam angle domain P6 shown in FIG. 4), the reactive force of the valve spring 14 virtually disappears, so that the shaft load acting on the plunger is substantially the reactive force of the plunger spring 26. Under this condition, the plunger 24 is pushed upward (in the region (1)) for the backlash of the engagement threads (which is on the order of tens of micrometers) plus the lift loss δ induced.

In other words, when the contact point of the rocker arm 16 and the cam 19*a* shifts onto the base circle of the cam 19*a* (cam angle domain P6 of FIG. 4), a positive valve clearance that amounts to the backlash of the engagement threads on the order of tens of microns plus retraction of the plunger 24 in the near-maximum cam angle domain is cancelled out by the lift loss δ. Under this condition, the friction between the friction surface F2 of the plunger 24 and the rocker arm 16 is small. Besides, the friction acting on the friction surface F3 of the plunger 24 is originally small. In other words, as the contact point shifts onto the base circle of the cam 19*a* (cam angle domain P6 of FIG. 4), the absolute value of the thrust torque TF exceeds the absolute value of the braking torque TB (−), so that the plunger 24 is moved (extended) upward (in FIG. 1) to annihilate the valve clearance through its sliding rotation.

As the valve clearance is annihilated by the upward movement of the plunger 24, frictional forces act on the slidable frictional surfaces F2 and F3 of the plunger 24, which prevents the shaft load supplied by the plunger spring 26 from being converted into thrust torque TF.

Then, after extending in the axial direction by the distance equal to the valve clearance in the region (1), the plunger 24 becomes stationary with its upper flank of the male thread 25 resting on the lower flank of the female thread of the housing 22, since the frictional braking torques acting on the slidable frictional surfaces F2 and F3 exceeds the thrust torque TF.

Thus, the contact point of the rocker arm 16 and the cam 19*a* restores its initial condition on the base circle of the cam (which corresponds to the cam angle position P1 in FIG. 4), and repeats the above torque balance sequence (2)-(3)-(2)-(1)-(2) in association with the rotational motion of the cam 19*a*.

In this way, when the valve clearance were increased in the valve operating mechanism, the mechanical lash adjuster 20 of this embodiment would first decrease the increment by extending the plunger 24 upward solely under the force of the plunger spring 26 acting as the shaft load, immediately before finishing the valve lifting operation (in the cam angle domain P6 in FIG. 4).

Second, the lash adjuster 20 would annihilate incremented valve clearance by extending the plunger 24 upward under the sole upward force of the plunger spring 26 acting as a shaft load while the contact point of the roller 17*b* of the rocker arm 16 is staying on the base circle of the cam 19*a* (in the cam angle domain P1 in FIG. 4).

In the event that a heated engine is stopped and cooled quickly, the mechanical lash adjuster 20 may fail to adjust a change in valve clearance due to a difference in thermal expansion coefficients of the cylinder head 11 and the valve 10, leaving a negative valve clearance and causing the valve seat face 10*a* of the valve 10 to float from the valve seat insert 11*b* at the time of restarting the engine. Similar valve floating can take place at the time of start-up when the valve seat face 10*a* is much too worn out.

In such cases as described above, the lash adjuster 20 of the present embodiment can eliminate such negative (or insufficient) valve clearance during a valve opening/closing operation by allowing the plunger 24 to move (retract) to increase the valve clearance when the shaft load applied by the cam 19*a* becomes approximately maximum (with the cam angle being in the cam angle domain P4 in FIG. 4) and the thrust torque TF exceeds the braking torque TB. As a result, an excessive valve lift nor improper sealability between the valve seat face 10*a* of the valve 10 and the valve seat insert 11*c* will not take place.

Figure 5:
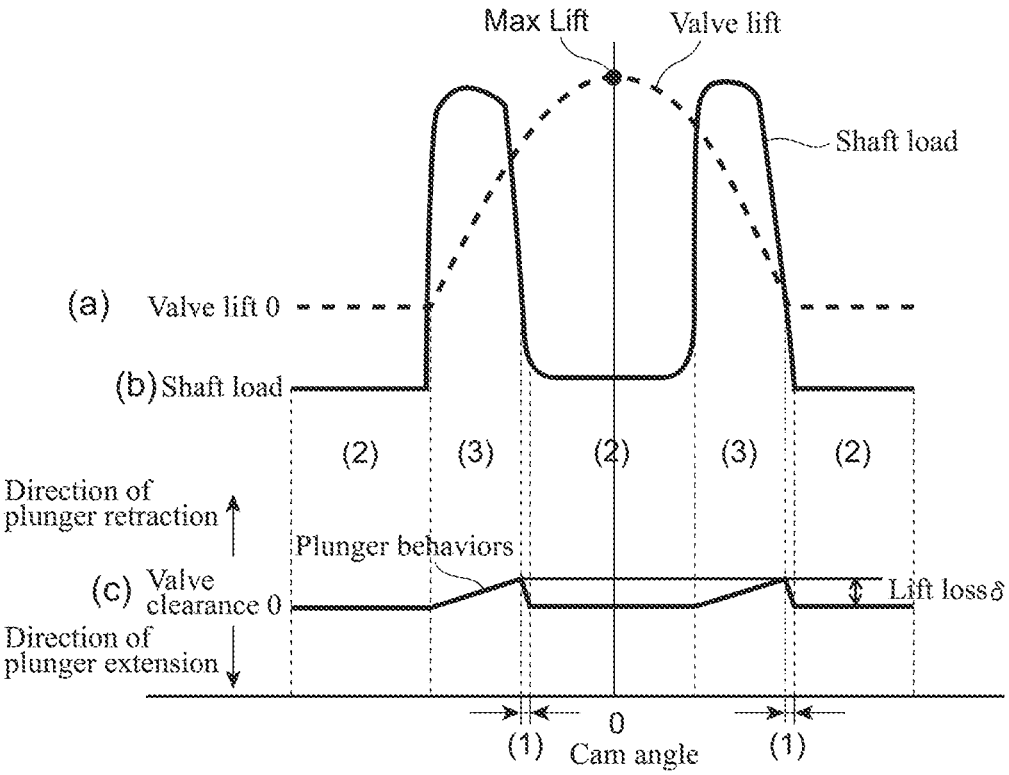
FIG. 5 illustrates a valve lift, a shaft load, and behaviors of the plunger as functions of cam angle when the engine is running at a high rpm.

FIGS. 5(*a*)-(*c*) show the valve lift, shaft load, and plunger condition as functions of the cam angle when the engine is running at a high rpm (above 3000 rpm for example). In contrast to a case where the engine is operated at a low rpm as shown in FIG. 4, the reactive force of the valve spring 14 is not a dominant component of the shaft load acting on the plunger when the engine is operating at a high rpm. In this case, the inertial forces of the rocker arm 16 and valve 10 of the valve control system become dominant. That is, the shaft load is greatly influenced by these inertial forces.

In contrast to a low rpm operation, under a high rpm operation, the timing at which the plunger 24 is subjected to a maximum shaft load takes place at the moment when the valve 10 begins to open and finishes closing as shown in FIG. 5 (*b*).

More particularly, although the valve clearance remains unchanged in the region (2) as it is initialized, the shaft load quickly increases with the increasing valve lift due to the inertial forces of the valve control operating system (such as rocker arm 16 and valve 10).

Under this condition, the thrust torque TF acting on the engaging thread of the plunger 24 grows quickly and overcomes the braking torque TB acting on the slidable frictional surfaces F2 and F3 (TB<TF) (in the shaft load region (3)), thereby rendering the plunger 24 moveable (retractable) downward (FIG. 1).

Thus, in the region (3) where the shaft load quickly grows, the plunger 24 is slightly retracted downward as in the instance of a low rpm operation, thereby giving a less valve lift than the intended Max Lift that should be otherwise given by the cam 19*a*. In other words, a lift loss δ is created by the retraction of the plunger 24 in the axial direction.

In the next region (1) past the region (3), the reactive force of the valve spring 14 is negligibly small, and the reactive force of the plunger spring 26 dominates the shaft load. Consequently, the plunger 24 is pushed upward by the plunger spring 26 to compensate for the incremented valve clearance (or the lift loss δ) caused by the retraction of the plunger 24 in the region (3).

It is noted that the torque balance of the plunger 24 changes as it enters the region (1) from the region (3) via the region (2), as in the case of a low rpm operation (shown in FIG. 4). However, when operating at a high rpm, there is a region (1) between the region (3) and the region (2) where the shaft load decreases so quickly that the region (1) is passed in substantially no time (that is, in almost negligible period of time), so that the torque balance region (3) seems to change directly to the region (1).

In the region (1), the valve clearance is nullified (or compensated for the lift loss δ plus the backlash of the thread) by a movement of the plunger 24. As a result, the braking torque TB acting on the slidable frictional surfaces F2 and F3 of the plunger 24 exceeds the thrust torque TF acting on the engaging thread. That is, $$TF \leq TB$$

in the region (2).

In the region (2), the engaging threads are unrotatable relative to each other, so that the plunger 24 remains immovable in the axial direction until the shaft load rises again. After the valve is given a valve lift of Max Lift in the region (2), the shaft load sharply increases immediately before closing the valve due to the inertial forces of the valve control system (specifically, the inertial forces of the rocker arm 16 and the valve 10).

The plunger 24 is then slightly retracted, as in the region (3) in which the shaft load rapidly increases at the beginning of valve lift, and the retraction invites a loss in valve lift (lift loss d). The lash adjuster falls in a condition represented by the region (2) where the reactive force of the valve spring 14 has almost disappeared and only the reactive force of the plunger spring 26 acts on the plunger 24 as a shaft load (in region (1). As a result, the plunger 24 is then pushed upward by a distance that amounts to the retraction experienced in the region (3), and restores the initial valve clearance set up in the region (2).

Figure 6:
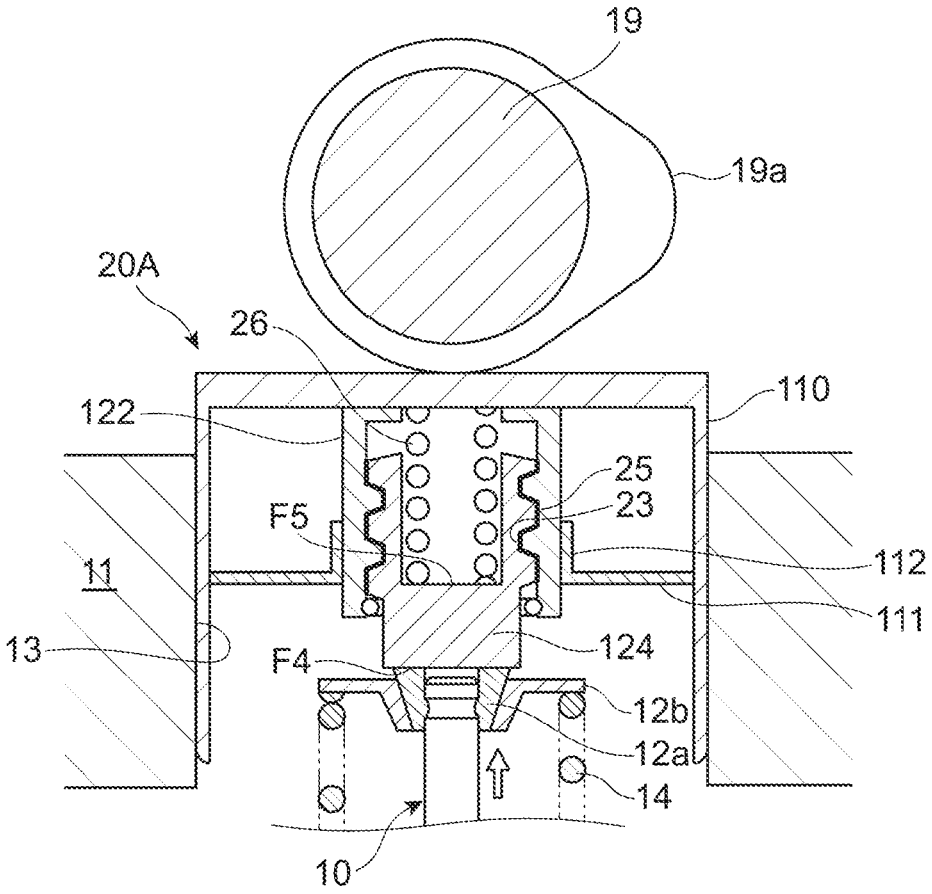
FIG. 6 is a longitudinal cross section of a mechanical lash adjuster for use with a direct acting type valve operating mechanism in accordance with a second embodiment of the invention.

Referring to FIG. 6, there is shown a second embodiment of the invention.

In contrast to the rocker arm type mechanical lash adjuster 20 described in the first embodiment, the second embodiment concerns a direct acting type mechanical adjuster 20A.

Reference numeral 10 indicates an air intake (exhaust) valve 10 crossing the air intake (exhaust) port P (shown in FIG. 1) formed in the cylinder head 11. The valve 10 is provided at one end of its valve stem with a cotter 12*a* and a spring retainer 12*b*, and between the spring seat 11*a* (FIG. 1)

and the spring retainer 12*b*, with a valve spring 14 for urging the valve 10 upward (FIG. 6) to close the port.

Arranged directly above the valve 10 is a cam 19*a* mounted on the camshaft 19. The mechanical lash adjuster 20A is inserted in a vertical bore 13 formed in the cylinder head 11 extending between the cam 19*a* and the cotta 12*a*.

In addition, the mechanical lash adjuster 20A comprises: a cylindrical bucket 110 which has a lower opening and is engaged with a bore 13 formed in the cylinder head 11; a cylindrical housing 122 securely fixed to the lower side of the ceiling of the bucket 110 to serve as a plunger engagement member, which has an inner female thread 23; a cup shape plunger 124 arranged inside the housing 122 and having an upper opening and a male thread 25 on the outer periphery thereof in engagement with the female thread 23 of the housing 122; and a plunger spring 26, arranged between the plunger 124 and the ceiling of the bucket 110 to urge the plunger 124 downward (FIG. 6) against the force of the valve spring 14 so as to extend the plunger from the housing 122.

Provided inside the bucket 110 is a circular disk shape partition wall 111 integral with the bucket 110. The partition wall 111 has at the center thereof an upright coaxial cylinder section 112 for securing attachment strength of the bucket 110 with the outer periphery of the housing 122.

The bucket 110 is held unrotatable by a fixing means (not shown) with respect to the bore 13, but the bucket 110 (and hence the mechanical lash adjuster 20A) can slidably move in the axial direction of the bore 13 in association with the cam 19*a* in rotation.

The lower end of the plunger 124 abuts against the upper end of the cotter 12*a* (mounted on one end of the valve 10), which serves as a shaft load transmission member, such that a large area of the slidable frictional surface F4 of the plunger 124 in contact with the valve 10 increases the second frictional torque that acts on the slidable frictional surface F4.

It is recalled that the lead and flank angles of the male thread 25 of the plunger 124 (female thread 23 of the housing 122) are set to the same lead and flank angles of the male thread 23 of the plunger 24 (female threads 23 of the housing 22) of the mechanical lash adjuster 20 in accordance with the first embodiment, so that the plunger 24 can extend or retract in the direction of the shaft load applied thereto, but becomes immovable when a frictional torque (braking torque) is generated by the friction between the slidable frictional surface F4 and the stem end of the valve 10 (or the cotter 12*b*) and/or between the slidable frictional surface F5 of the plunger 124 and the plunger spring 126, thereby rendering the engaging threads unrotatable.

Behaviors of the mechanical lash adjuster 20A under the force of the cam 19*a* in rotation are similar to those of the mechanical lash adjuster 20 of the first embodiment shown in FIGS. 4 and 5, so that the further description of the movements will be omitted.

Figure 7:
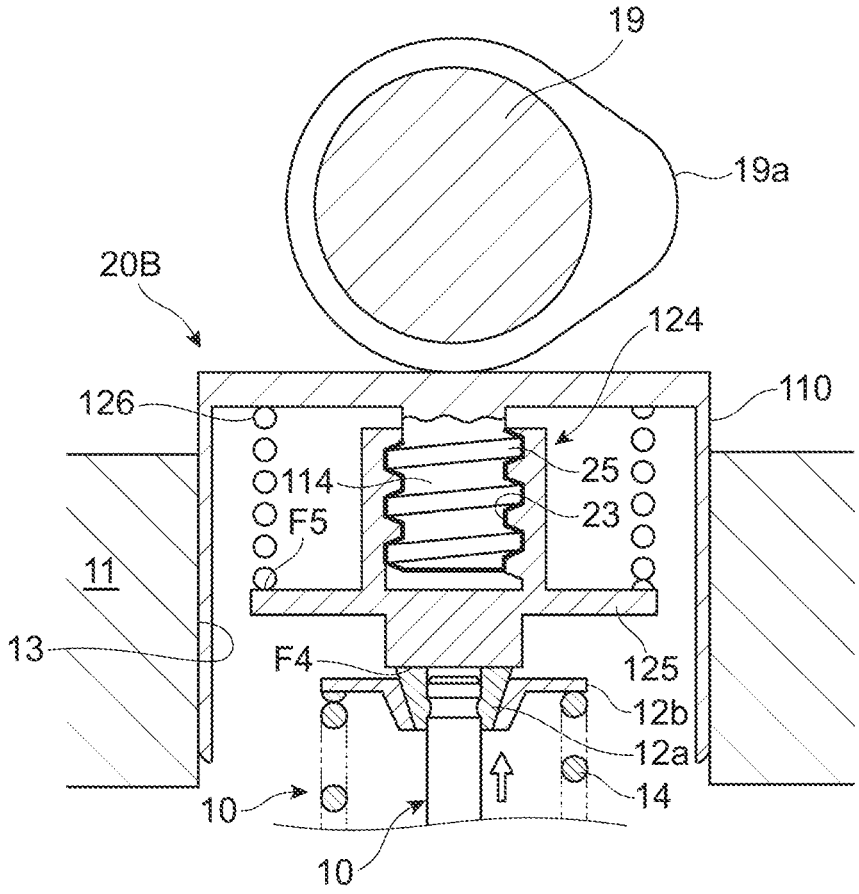
FIG. 7 is a longitudinal cross section of a mechanical lash adjuster for use with a direct acting type valve operating mechanism in accordance with a third embodiment of the invention.

Referring to FIG. 7, there is shown a third embodiment of the invention.

The mechanical lash adjuster 20B shown in FIG. 7 is also a direct acting type mechanical lash adjuster, similar to the one described in the second embodiment.

It is recalled that in the mechanical lash adjuster 20A of the second embodiment the male thread 24 formed on the outer periphery of the cup shape plunger 124 is engaged for axial movement with the inner female thread 23 formed inside the housing 122 integral with the bucket 110.

In the third mechanical lash adjuster 20B, the bucket 110 is provided at the lower end thereof with a rod member 114 integral therewith and extending therefrom to serve as a plunger engagement member. Formed on the outer periphery of the rod member 114 is a male thread 25 in engagement with the female thread 23 formed in the inner periphery of a cup shape plunger 124. The plunger has an upper opening such that the male thread 25 of the rod member 114 and the female thread 23 of the plunger 124 are in slidable engagement to allow axial movement of the plunger 124.

The plunger 124 is provided with a flange shape spring receptor 125 for retaining a plunger spring 26 between the spring receptor 125 and the ceiling of the bucket 110 such that the spring receptor 125 has a slidable frictional surface F5 in contact with the plunger spring 126.

The rest of the features of the third embodiment are the same as those of the second embodiment, so that a further description of the third embodiment will be omitted.

In the third embodiment, the diameter of the plunger spring 126 is significantly larger than that of the plunger spring 26 of the second embodiment, so that varied types of plunger springs 126 can be used with it. For example, a plunger spring having a larger spring constant can be selected to enhance the frictional torque to be generated on the slidable frictional surface F4 to thereby shortening the axial length of the plunger spring than that of the spring used in the second embodiment.

Figure 8:
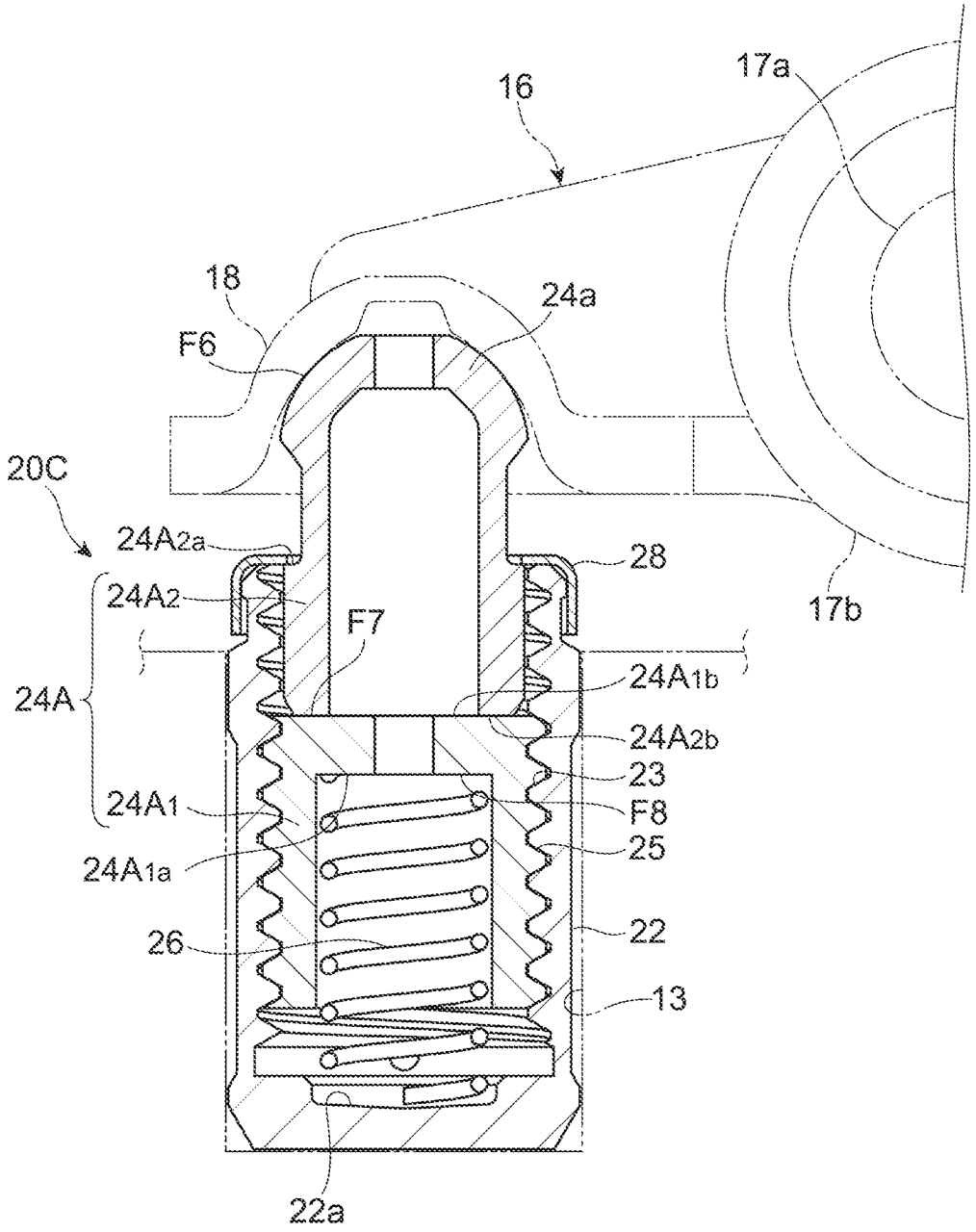
FIG. 8 is a longitudinal cross section of a mechanical lash adjuster for use with a rocker arm type valve operating mechanism in accordance with a fourth embodiment of the invention.
Figure 9:
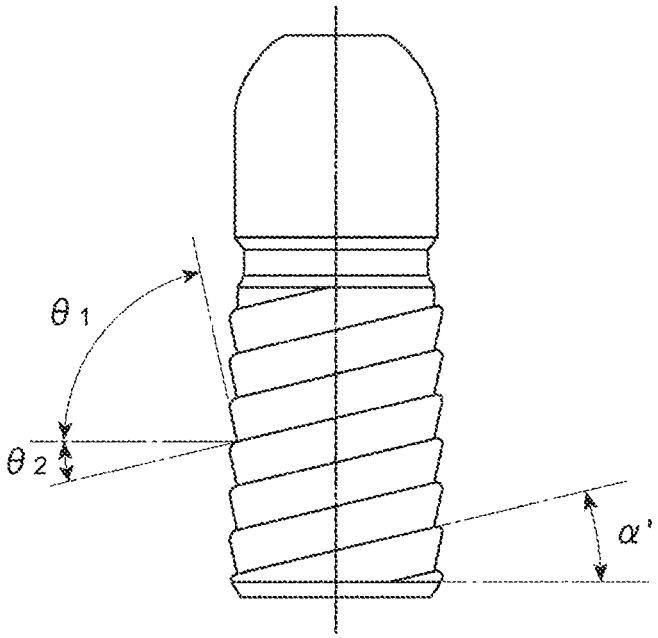
FIG. 9 shows in enlarged side view a pivot member of a conventional mechanical lash adjuster.

Referring to FIG. 8, there is shown a fourth embodiment of the invention.

A mechanical lash adjuster 20C shown in FIG. 8 is also a rocker type mechanical lash adjuster, in which a plunger 24A, arranged inside the cylindrical housing 22, is divided into two parts, with one part being a plunger base section 24A1 formed with a male thread 25 and the other part being a leading section 24A2 formed with a pivot 24*a*. As in the first embodiment, the cylindrical housing 22 is retained unrotatable by the friction between the lower end of the cylindrical housing 22 and the bottom of the bore 13.

In more detail, the plunger base section 24A1 has a cup-shape turned upside down and arranged inside the lower section of the housing 22, and is formed on the outer periphery thereof with a male thread 25 in threaded engagement with a female thread formed in the housing 22. The male thread 25 and the female thread 23 are triangular threads for example, each having a lead angle of 30 degrees and an upper and a lower flank angle of 30 degrees as in the foregoing embodiments. A plunger spring 26 for urging upward the plunger base section 24A1 is disposed between the lower surface 24A1*a* of the ceiling of the plunger base section 24A1 and the upper surface 22*a* of the bottom of the cylindrical housing 22.

On the other hand, the leading section 24A2 of the plunger 24 is a generally hollow cylinder having an upper pivot section 24*a* and a lower opening. The leading section 24A2 is provided on the outer periphery thereof with a step 24A2*a* which is engaged with the inner periphery of an annular cap 28 mounted on an upper open end of the housing 22 so as to prevent the leading section 24A2 from coming off the housing 22. As a result, the base section 24A1 and the leading section 24A2 are in forced contact with each other under an axial force exerted by the plunger spring 26. The leading section 24A2 of the plunger 24A is biased upward to protrude from the cylindrical housing 22.

Thus, when the force of the cam 19*a* acts on the plunger 24A as a shaft load, the shaft load is transmitted to the male thread 25 of the plunger base section 24A1 and the female thread 23 of the housing 22, which in turn generates a thrust torque TF for causing the plunger 24A to be rotated. At the same time, a frictional (braking) torque TB6 that suppresses the rotation of the plunger 24A takes place due to the friction between the sliding surface F6 of the pivot section 24*a* of the plunger 24A in contact with the rocker arm 16. Similarly, a frictional braking torque TB7 is generated that acts on the slidable frictional surface F7 of the upper end 24A1*b* in contact with the lower end 24A2*b* of the leading section 24A2 of the plunger 24A, and so is a frictional braking torque TB8 that acts on the slidable frictional surface F8 of the inner ceiling 24A1*a* of the plunger base section 24A1 in contact with the plunger spring 26.

In this mechanical lash adjuster 20C, the lead angle of the male thread 25 of the plunger base section 24A1 (and of the female thread 23 of the cylindrical housing 22) is set to 30 degrees for example and the upper and lower flank angles of the male thread 25 (and female thread 23) are also set to the same angle (in this example, 30 degrees), whereby the plunger 24A (plunger base section 24A1) is moveable in the direction of the load shaft applied thereto through sliding rotation of the engaging threads, resulting in extension or retraction of the plunger, but becomes immovable when the frictional braking torques TB6, TB7, and TB8 take place on the slidable frictional surfaces F6, F7, and F8, respectively, such that the frictional braking torques stop the relative sliding rotations of the engaging threads of the base section 24A1 of the plunger 24A.

More particularly, the engaging threads are configured such that the sliding rotation of the plunger 24A will be stopped whenever a smaller one of the resultant frictional torque of TB6 and TB8 or of TB7 and TB8 exceeds the shaft load TF.

Stated in more detail, while the slidable frictional surfaces F6 and F7 are subjected to the force of the cam 19*a*, the slidable frictional surface F8 is subjected only to the force of the plunger spring 26, so that the frictional torque TB8 acting on the slidable frictional surface F8 is significantly smaller than the frictional torques TB6 and TB7 acting on the slidable frictional surfaces F6 and F7. Consequently, when the engaging threads of the plunger 24 are rotatable (slidable) under a shaft load, the slidable frictional surface F8 slides first, and then either the face F6 or the face F7 subjected to a smaller friction torque, slides.

Thus, in this embodiment the engaging threads (and hence the plunger 24A) are configured to become unrotatable when a resultant torque TB of TB7 and TB8 exceeds the thrust torque TF $$TF \leq TB$$

provided that the frictional torque TB6 acting on the slidable frictional surface F6 surpasses the braking torque TB7 acting on the slidable frictional surface F7, $$TB7 < TB6.$$

In other words, the threads are designed to become not slidable when the thrust torque TF and the braking torque TB balances out or when the braking torque Tb surpasses the thrust torque TF (where the braking torque TB is the sum of the frictional torques TB7 and TB8), that is when $$TF \leq TB(=TB7+TB8).$$

To do this, the lead and flank angle of the male thread 25 (and female thread 23) are set to 30 degrees.

On the other hand, when the thrust torque TF surpasses the braking torque TB, the engaging threads of the plunger 24A can slide (rotate), causing the plunger 24A to be moved in the direction of the shaft load to adjust the valve clearance.

Specifically, the operating characteristics of the plunger 24A are similar to those of the plunger 24 of the lash adjuster described in the first embodiment (FIGS. 4 and 5). Thus, any incremented valve clearance will be annihilated at some point of valve opening/closing operation, for example, immediately before completing valve lifting, when the force of the plunger spring 26 is the only shaft load acting on the plunger 24A (in the region (1) of FIGS. 4 and 5), so that the plunger 24A can move (upward in FIG. 1 to extend itself) to annihilate the incremented valve clearance.

On the other hand, if the valve clearance has decreased, the plunger 24A is moved to increase the valve clearance sometime during a valve opening/closing operation, for example when a near-maximum cam force of the cam 19*a* is applied to the plunger 24A as the shaft load (FIG. 4 and FIG. 5(3)), forcing the plunger 24A to retract.

The rest of the features of the lash adjuster 20C are the same as those of the lash adjuster 20 of the first embodiment, so that a further description of the plunger 24A will be omitted by referring similar or the same parts of the lash adjusters with the same reference symbols in the two embodiments.

It should be noted that although both the lead angle and the flank angles (upper and lower flank angle) of the engaging male thread 25 (female thread 23) are set to 30 degrees in the first through fourth embodiments, the lead angle can be varied in the range from 10 to 40 degrees and so can be the flank angle in the range from 5 to 45 degrees.

When the lead angles of the engaging threads are less than 10 degrees, smooth sliding rotation of the threads is difficult due to the friction between the threads. When the lead angles exceed 40 degrees, it is difficult to suppress the sliding rotation of the engaging threads by the frictional torque generated between the shaft load transmission member and the slidable frictional surface of the plunger.

Consequently, the lead angles of the threads are preferably set in the range from 10 to 40 degrees inclusive to ensure on one hand smooth sliding rotation of the engaging thread of the plunger irrespective of the direction of the shaft load acting on the plunger while ensuring on the other hand suppression of the sliding rotation of the engaging thread by the frictional torque generated between the shaft load transmission member and the slidable frictional surface of the plunger.

More particularly, when a large (small) frictional torque is generated by the slidable frictional surface (F2, F4, F6) of the plunger (24, 124, 24A) in contact with the shaft load transmission member (rocker arm 16, cotter 12*a*), a small (large) lead angle be set. That is, a lead angle be set to the plunger in accord with the magnitude of a primary frictional torque that takes place on the slidable frictional surface (F2, F4, F6) of the plunger in contact with the shaft load transmission member (rocker arm 16, cotta 12*a*).

It is noted that if the flank angles are less than 5 degrees, the threads are substantially square threads, which have a very small frictional angle, so that it becomes meaningless to vary the flank angles, and still more, it is difficult to fabricate threads of high precision that are not affected by lead errors. On the other hand, machining of threads having flank angles exceeding 45 degrees is easy. However, their friction angle is then so large that the threads can become 'self-independent' quite easily irrespective of the magnitude of the lead angle, and the flank angle lose its meaning as an adjustable control parameter.

Therefore, a proper lead angle $\alpha$ is set up first primarily in accordance with the magnitude of the frictional torque generated by the friction between the slidable frictional surface (24, 124, and 24A) of the plunger and of the shaft load transmission member (rocker arm 16, and cotter 12*a*). Next, taking into account of the fact that slidable engagement of the threads is difficult (easy) for threads having large (small)

flank angles, proper flank angles be set up that permits fine adjustment of rotational timing and slidability of the engaging threads.

In the foregoing embodiments, trapezoidal or triangular male and female threads (25, 23) have the same upper and lower flank angles. However, they can be trapezoidal or triangular threads whose upper flank angle is different from the lower flank angle.

It is recalled that the male threads 25 of the plunger 24, 124, and 14A1 in the first, second, and third embodiments above, and the male thread 25 of the rod member 114 and the female thread 23 of the plunger 124 in the third embodiment are all single-lead threads. However, the male threads 25 of the plungers (24, 124, 24A1) and the female threads 23 of the housings 22 and 122 may be multi-lead threads, such as for example 2- or 3-lead threads.

A multi-lead thread has a multiplicity of leads disposed at equal intervals in the axial direction, which advantageously allows a large pitch for a given lead as compared with a single-lead thread. Particularly, when a large lead angle (30 degrees, for example) must be chosen to meet the requirement that they can slidably rotate relative to each other under a given shaft load acting on the plunger in either axial direction, it is advantageous to employ a multi-lead thread, since a multi-lead thread allows selection of not only an appropriate pitch in accord with the diameter thereof, but also a standardized thread shape and thread angle in accord with Japanese Industrial Standards (JIS).

Thus, in the design of engagement threads, the range of preferred lead and flank angles can be extended by taking account of multi-lead threads.

The use of multi-lead threads in the plunger of a mechanical lash adjuster is desirable in that it reduces the pressure acting on the respective thread surfaces under a given shaft load, thereby reducing the wear of the threads, especially when the plunger experiences large shaft loads.

BRIEF DESCRIPTION OF SYMBOLS

10 valve
11 cylinder head
12*a* cotta
14 valve spring
20, 20A, 20B, 20C mechanical lash adjuster
22, 122 cylindrical housing (plunger engagement member)
23 female thread
24, 124, 24A plunger
24*a* pivot section of plunger
24A1 plunger base section
24A2 leading section of plunger
25 male thread
26, 126 plunger spring
114 rod member (plunger engagement member)
F2, F6 slidable frictional surfaces of plunger in contact with shaft load transmission member (rocker arm)
F3, F5, F8 slidable frictional surfaces of plunger in contact with plunger spring
F4 slidable frictional surface of plunger in contact with cotta
F7 slidable frictional surface of plunger base section in contact with leading section of plunger
W shaft load acting on plunger
$\alpha$ lead angle of thread
$\theta$23*a* upper flank angle of thread
$\theta$25*b* lower flank angle of thread
TF thrust torque
TB braking torque

The invention claimed is:

1. A mechanical lash adjuster for adjusting a valve clearance of the valve, the adjuster arranged between a cam of a valve operating mechanism and one end of a stem of a valve urged by a valve spring for closing a valve port, the lash adjuster comprising:

a plunger subjected to a shaft load exerted by the cam; an unrotatably secured plunger engagement member in threaded engagement with an engagement thread of the plunger to allow axial movements of the plunger; and a plunger spring urging the plunger against an action of the valve spring, the lash adjuster characterized in that lead and flank angles of engaging threads are set so as to:

allow the plunger to extend or retract in an axial direction of the shaft load applied thereto through sliding rotation of the engaging threads;

but render the engaging threads unrotatable primarily due to a frictional torque that acts on a slidable frictional surface of the plunger in contact with a shaft load transmission member of the lash adjuster.

2. The mechanical lash adjuster according to claim 1, wherein the lead angles of the engaging threads are set in the range from 10 to 40 degrees while the flank angles of the engaging threads are set in the range from 5 to 45 degrees.

3. The mechanical lash adjuster according to claim 2, wherein the engaging threads are multi-lead threads.

4. The mechanical lash adjuster according to claim 1, wherein the engaging threads are multi-lead threads.

* * * * *